United States Patent [19]

Weiss

[11] Patent Number: 5,058,578

[45] Date of Patent: Oct. 22, 1991

[54] RESPIRATORY DEVICE

[76] Inventor: Alvin H. Weiss, 26 Oakland Ave., Shrewsbury, Mass. 01545

[21] Appl. No.: 259,209

[22] Filed: Oct. 18, 1988

Related U.S. Application Data

[63] Continuation of Ser. No. 919,806, Oct. 16, 1988, abandoned, which is a continuation of Ser. No. 726,410, Apr. 24, 1985, abandoned.

[51] Int. Cl.[5] ..... A62B 7/10

[52] U.S. Cl. ..... 128/205.27; 128/205.29; 128/201.25

[58] Field of Search ..... 128/201.18, 201.22, 128/201.23, 201.25, 201.26, 202.21, 205.27, 205.28, 205.29, 206.11, 206.12, 206.17, 206.18, 206.21, 206.29, 207.13, 207.14, 202.13, 202.22, 202.26, 206.28

[56] References Cited

U.S. PATENT DOCUMENTS

| | | | |
|---|---|---|---|
| 533,880 | 2/1895 | Forné | 128/205.29 |
| 726,037 | 4/1903 | Ferré . | |
| 2,385,938 | 10/1945 | Pierce | 128/147 |
| 3,142,549 | 7/1964 | Klusewitz | 128/206.17 |
| 3,381,454 | 5/1968 | Sponsel | 128/205.28 |
| 3,658,058 | 4/1972 | Neidhart | 128/147 |
| 3,710,393 | 1/1973 | Douglas | 128/201.23 |
| 3,731,678 | 5/1973 | Pryzel | 128/205.27 |
| 3,944,403 | 5/1976 | Simpson | 128/206.18 |
| 4,019,509 | 4/1977 | Li | 128/202.22 |
| 4,030,887 | 6/1977 | Poli | 23/232 |
| 4,088,461 | 5/1978 | Brauer | 128/206.17 |
| 4,154,235 | 5/1979 | Warncke | 128/201.25 |
| 4,262,666 | 4/1981 | Nelson | 128/203.23 |
| 4,382,440 | 5/1985 | Kapp | 128/201.25 |
| 4,572,178 | 2/1986 | Takase | 128/201.25 |

FOREIGN PATENT DOCUMENTS

| | | | |
|---|---|---|---|
| 509032 | 10/1930 | Fed. Rep. of Germany | 128/205.27 |
| 1323477 | 2/1963 | France | 128/202.13 |
| 372500 | 6/1939 | Italy | 128/206.12 |

OTHER PUBLICATIONS

Universal and the Fireman's Gas Masks (1926) Detection, Reduction and Control of Gaseous Contaminenets, pp. 6–9 (no date).

*Primary Examiner*—Max Hindenburg
*Assistant Examiner*—John P. Lacyk
*Attorney, Agent, or Firm*—Blodgett & Blodgett

[57] ABSTRACT

A respiratory protection device for protection against airborne toxic material comprising a rigid tube having an inlet opening at one end, an outlet opening at the opposite end, a filter for particulate material at the inlet opening, two distinct layers of gas adsorptive material which are arranged in series between the inlet and outlet openings, and means for retaining the layers of adsorptive material within the tube. The chemical composition of the layers differ from each other and the compositions have different adsorptive characteristics.

3 Claims, 4 Drawing Sheets

RESPIRATORY DEVICE

This is a continuation of co-pending application Ser. No. 919,806 filed on Oct. 16, 1988, now abandoned which is a continuation of Ser. No. 726,410 filed on Apr. 24, 1985, now abandoned.

BACKGROUND OF THE INVENTION

The present invention relates generally to a respiratory protection device and particularly to a multi-purpose highly portable respiratory protection device.

Each year, thousands of lives are lost and many more thousands of individuals are injured from fires. Most of the deaths and injuries are from the effects of the smoke and toxic gases which are produced in the fires. The toxicity of gases in fires is constantly increasing due to the ever increasing use of plastic materials in our modern society. Most fire casualties occur one or two at a time, generally from residential fires. Occasionally, large numbers of people perish from fires in hotels, nursing homes, apartment complexes, and airlines. In many cases, particularly aircraft fires, people are usually killed by poisonous fumes in the initial stages of the fire before there is a substantial heat buildup. Contrary to what is generally believed, very few people die in bed but rather are overcome while trying to escape the fire. In most cases, the victims are unable to reach a source of uncontaminated air in time to survive or to escape injury. Those who do survive can be left with lung damage or the threat of possible long-term health effects resulting from inhalation of toxic combustion products.

The smoke from a fire presents three hazards. First, there is a thermal heating effect. Secondly, the smoke contains a large amount of choking particulate matter. The third hazard is the lethal concentration of several toxic gases in the smoke.

The thermal heating effect is a relatively minor problem in areas that are not actually burning. The choking particulate matter can be filtered with conventional filter paper material or clothing. The toxic gas hazard is the most serious since the victim in a fire has nothing at his/her immediate disposal which will afford protection against toxic gases.

Inhalation of carbon monoxide is considered to be the principle cause of death in fires. However, other products of combustion such as hydrogen cyanide, hydrogen chloride, and other acid gases affect the fire victim's mental capacity and causes confusion. This confusion reduces the likelihood of escape. For example, hydrogen chloride forms hydrochloric acid in the mucus membranes of the respiratory tract, thereby causing laryngitis, glottal edema, bronchitis, pulmonary edema, and death. This gas is a powerful lachrymator which also inhibits escape from a fire In addition to fires, there are other nonfire emergencies which threaten the persons respiration. Examples of such emergencies are a chemical spill, or chemical or biological warfare attack. In all of these situations, the basic problem is to survive for the several minutes that it takes to be rescued or to escape from the contaminated area to a clean area.

Respiratory protection devices have been utilized for a long time. Very sophisticated respiratory protection apparatus is now currently being used by the military, in industry, and in the fire service. Some of the breathing apparatus is self-contained and uses bottled air or oxygen. Filter-type gas masks are also used by the military and in some civilian applications. Military and civilian filter-type gas masks containing ASC Whetlerite have been found to be extremely effective. These devices are designed to protect the individual against smoke and vapors for hours. However, they are used only for those situations where an individual knowingly or expectingly encounters a situation in which he/she will be subjected to dangerous vapors, gases, or smoke. For example, military personnel are issued gas masks in certain training or combat situations. Firefighters are issued gas masks or self-contained breathing apparatus and have them at their disposal at the scene of a fire. Unfortunately, because of the cost and bulk of SCBA Equipment and gas masks, they are not universally available to everyone at every time. Even if the individual had the foresight and could afford some of the sophisticated respiratory protection equipment which is now available, it would be impractical to have this equipment in his/her position at all times.

In recent years, a number of simpler devices have been developed and marketed that attempt to provide the general public with a degree of protection in the event that they are exposed to a fire situation. These devices are designed to provide the individual with safe breathing air and thereby provide time for the individual to escape to a safe environment. These devices range from an expensive unit which utilizes a pressurized cylinder of oxygen to a simple bag to entrap "safe" air. The air filled bag is thrown over the head and shoulders and worn as a hood during escape from the fire. Other simple devices have been developed for filtering out toxic materials and these have been found to be essentially useless. Except for cylinder oxygen, none of the prior art devices protect against CO. None of the filter-type devices provide complete protection against the hazardous airborne materials which are most likely to be encountered in emergency situations. For example, some devices are effective in filtering out smoke particulates but not toxic gases. Other devices utilize a charcoal filter for removing some heavy products of combustion but not others, such as carbon monoxide which is one of the main killers from a fire. These and other difficulties experienced with the prior art devices have been obviated by the present invention.

It is, therefore, a principle object of the invention to provide a small portable respiratory protection device which is effective in providing protection against airborne toxic material, particularly CO.

Another important object of the invention is the provision of a portable respiratory device which provides protection against CO and also provides a heat sink against hot gases including the heat from oxidation of CO.

Another object of this invention is the provision of a portable respiratory protection device which provides protection from contaminated air which includes particulates and toxic gases.

A further object of the present-invention is the provision of a portable respiratory protection device which provides universal protection for different types of emergency situations involving contaminated air.

It is another object of the present invention to provide a respiratory protection device that includes different filter materials which are arranged so that the effectiveness of the individual components of the filter are enhanced.

A still further object of the invention is the provision of a respiratory protection device which is simple in construction, which is inexpensive to manufacture and which is extremely easy to use.

With these and other objects in view, as will be apparent to those skilled in the art, the invention resides in the combination of parts set forth in the specification and covered by the claims appended hereto.

SUMMARY OF THE INVENTION

In general, the invention consists of a portable respiratory protection device which includes at least two distinct layers of gas adsorptive material within an elongated rigid tube which is adapted to be held in the mouth. The tube has an inlet opening which is covered by a filter for particulate material.

BRIEF DESCRIPTION OF THE DRAWINGS

The character of the invention, however, may be best understood by reference to one of its structural forms, as illustrated by the accompanying drawings, in which.

DETAILED DESCRIPTION OF THE INVENTION

Figure 1:
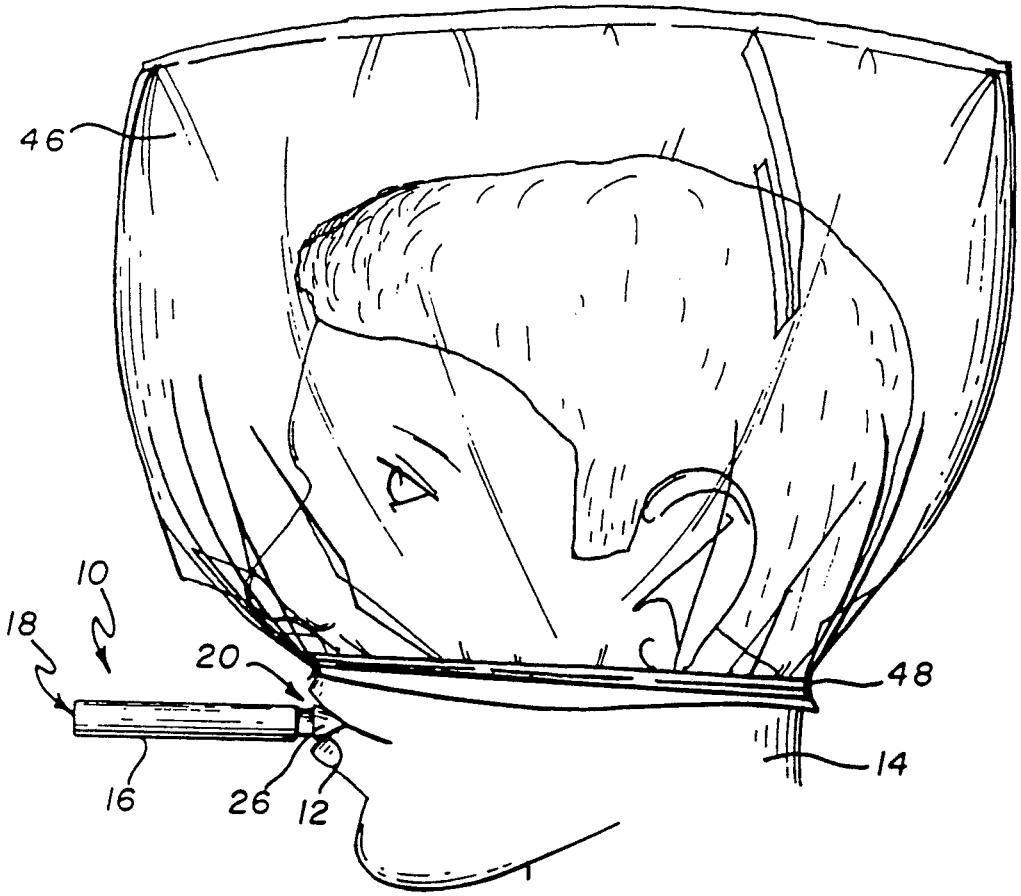
FIG. 1 is a side elevational view showing the respiratory protection device of the present invention in use.
Figure 2:
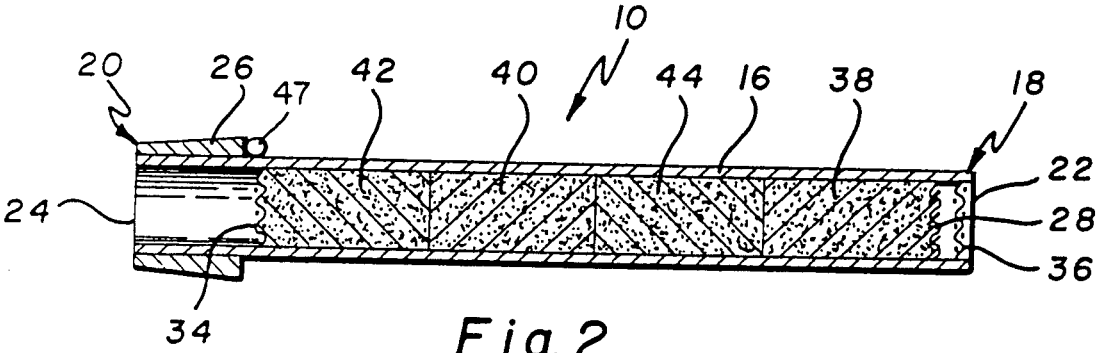
FIG. 2 is a longitudinal cross-sectional view of the respiratory protection device.

Referring first to FIGS. 1 and 2, the respiratory protection device of the present invention is generally indicated by the reference numeral 10 and is shown in use in FIG. 1 by being held in the mouth 12 of a human being 14. The device 10 comprises a cylindrical tube 16 having an inlet end, generally indicated by the reference numeral 18 and an outlet end, generally indicated by the reference numeral 20. The inlet end 18 has an inlet opening 22 and the outlet end 20 has an outlet opening 24. A mouth piece 26 is located at the outlet end of the tube and consists of a tapered sleeve which is attached to the outside of the tube. A filter 28 is located at the inlet end of the tube 16 so that it extends across the inlet opening 22 as shown in FIG. 2. The filter 28 consists of a piece of cloth or paper for filtering particulates. The tube 16 is made of a relatively rigid material, such as aluminum, plastic, and is approximately the size of a cigar, for example, having a diameter of $\frac{7}{8}$ inches and a length of 6 inches. The tube 16 contains powdered or granular gas adsorptive material which is retained between a porous wall or screen 36 at the inlet end 18 and a porous wall or screen 34 at the outlet end 20. The screen 36 also retains the filter 28.

The gas adsorptive material in the tube 16 comprises a plurality of distinct layers which are arranged in series between the screens 34 and 36. Beginning from the inlet end, the first layer of gas adsorptive material 38 consists of a high surface area impregnated active carbon, such as type ASC Whetlerite which is marketed by Calgon Corporation of Pittsburgh, Pa., and which is impregnated with metal oxides such as cupric and chromate salts which react with HCN and CICN. The second layer 44 consists of an oxidation catalyst, preferably a catalyst material which is sold under the tradename HOPCALITE. The third layer 40 consists of a sodium zeolite, preferably zeolite Na—Y or zeolite Na—X. The fourth layer 42 consists of a zeolite having different adsorptive characteristics from the zeolite of layer 40. The zeolite layer 42 is zeolite H, preferably H-Mordenite or H-Y. As shown in FIG. 1, the respiratory protection device 10 of the present invention includes an airtight clear plastic bag 46 which is adapted to fit over the user's head to a point below the user's nose. The bag 46 is maintained in a sealed condition on the user's head by means of an elastic band 48. In the preferred embodiment, each of the layers 38, 40, 42, and 44 consists of between 20 and 25 grams of material The particular zeolites which comprise the layers 40 and 42 are identified in and described in greater detail in a book by Donald W. Breck entitled: Zeolite Molecular Sieves published by John Wiley & Sons, Inc., 1974.

The operation and advantages of the present invention will now be readily understood in view of the above description.

Prior to use, tube 10 is enclosed within the sealed plastic bag 46. The device 10 is small enough to be conveniently carried within a person's pocket or in a purse. The device can also be kept by a person's bed or other convenient location in the room. The small size of the device enables it to be conveniently accessible at all times.

During an emergency, such as a fire or accidental chemical discharge in which an individual suddenly finds himself or herself in a toxic gas environment, the seal on the plastic bag 46 is broken. The tube 16 is removed from the bag and the mouth piece 26 is inserted in the mouth. The bag 46 is then applied over the head so that the nose is covered but not the mouth. The elastic band 48 which is located at the opening end of the bag 46 maintains the bag in a sealed condition about the users head. The individual then seeks to escape the contaminated area while breathing through the tube 16. The amount of material within the tube 10 enables the individual to breathe through the tube for approximately 10–20 minutes without inhaling any toxic chemicals. This is usually more than enough time to escape from most emergency situations or, at the very least, enables the individual to escape the area of heaviest concentration of lethal or toxic gases.

Figure 3:
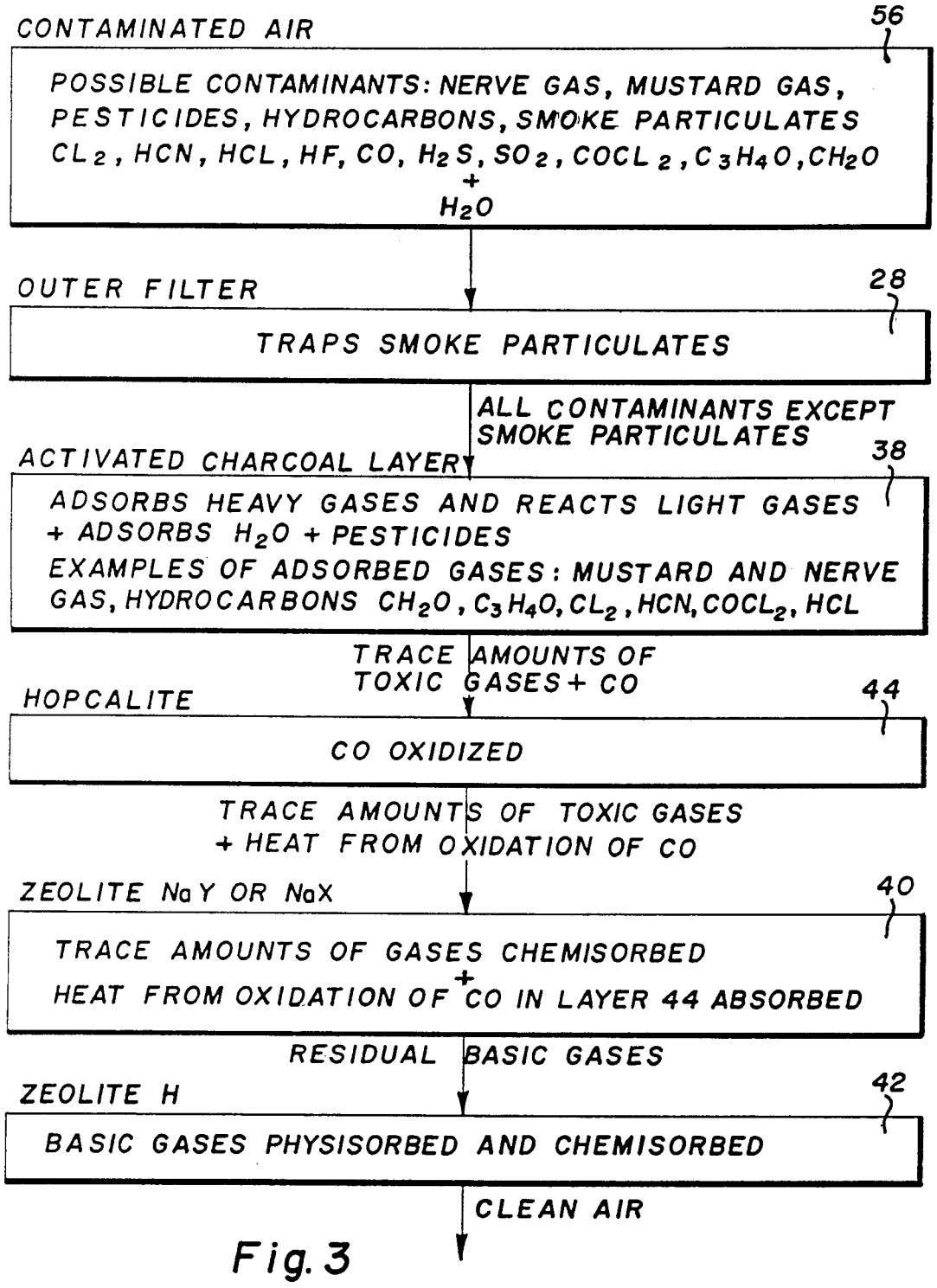
FIG. 3 is a flow diagram showing the various filtering stages of the respiratory protection device.

Referring particularly to FIG. 3, the adsorption sequence of the device 10 is graphically illustrated. Block 56 shows possible contaminants which may be encountered in different emergency situations. It is highly unlikely that all of the contaminants listed in block 56 would be present in a single situation. In most cases, only a few of the contaminants shown in block 56 would be present. However, during an emergency situation, whatever contaminants are in the air, are first drawn in through the screen 36 and filter 28 which physically traps particulate material, such as smoke particulates. The gases then enter the impregnated active carbon layer 38. The impregnated active carbon layer 38 adsorbs heavy gases and reacts with light gases. The layer 38 also adsorbs water and pesticides. Examples of adsorbed gases are nerve and mustard gas, pesticides, hydrocarbon, HCHO (formaldehyde), $C_3H_4O$ (acrolein), $CL_2$ (chlorine), HCN (hydrogen cyanide), $COCl_2$ (phosgene), and HCl (hydrogen chloride). HCN and organic gases are both adsorbed and oxidized by the carbon layer 38. The adsorption of $H_2O$ by the carbon layer 38 is extremely important with respect to the oxidatioun catalyst layer 44 which must be dry in order to efficiently oxidize CO to $CO_2$. Some of the lighter compounds pass through the activated carbon layer. Lower concentrations of acid and basic gases, including carbon monoxide, pass into the layer 44, wherein the carbon monoxide is oxidized. In the absence of moisture the oxidatious catalyst layer 44 has a finite life. CO is oxidized on a surface oxygen site. Any gases which pass into the sodium zeolite layer 40 are physically adsorbed and the acid gases are chemisorbed. The Na—Y zeolite adsorbs any residual gases that might break through the carbon layer 38 as well as provides a heat capacity mass to remove the heat of oxidation of the CO in the layer 44. The acid gases react with the highly basic sodium cations in the sodium zeolite to yield non-volatile compounds. Any residual basic gases which enter the zeolite layer 42, are both physically and chemically adsorbed. The chemi-adsorption of basic gases consists of an acid-base neutralization, such as the following: $H^+Z^- + NH_3 — NH_4^+Z^-$. The air which passes from the layer 44 and into the persons mouth of the outlet opening 24 is clean air, that is, free of toxic materials.

Attached to the outside of tube 16 is a visually discernible moisture indicator 47, such as $CASO_4$ which is sold under the trade name DRIERITE. The DRIERITE is in the form of a pellet which is normally blue when in the anhydrous condition and pink in the hydrated condition. Prior to being used, the respiratory protection device 10 is kept inside a sealed plastic bag, such as the bag 46 shown in FIG. 1. The plastic bag keeps moisture away from the adsorbing material within the tube 16 so that the layer 44 maintains its effectiveness. If the DRIERITE pellet turns pink, the user is thereby warned that moisture has entered the plastic bag and that there is a possibility that the carbon layers 38 have become saturated with water, thereby rendering the carbon layers ineffective to prevent water from reaching the layer 44.

First Modification

Figure 4:
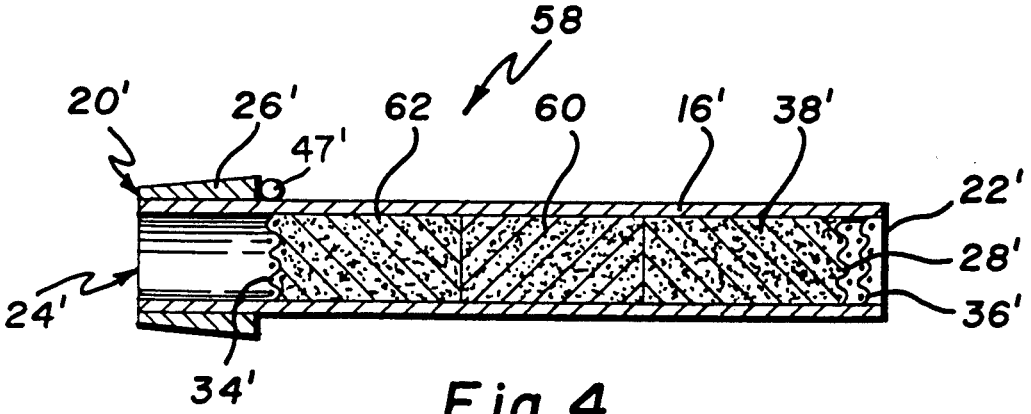
FIG. 4 is a view similar to FIG. 2 showing a first modified respiratory protection device.

Referring particularly to FIG. 4, there is shown a first modified respiratory protection device, generally indicated by the reference numeral 58. Respiratory protection device 58 is similar to device 10 and all comparable elements are identified with the same reference numerals as those of element 10 with the addition of a prime after each numeral. The only difference between the modified respiratory protection device 58 and the device 10 is that device 58 has three adsorptive layers within the tube 16' instead of four.

The first layer of adsorbent material which is adjacent the inlet opening 22' is impregnated active carbon 38', preferably type ASC Whetlerite. The second or middle layer 60 consists of an oxidation catalyst and the last layer 62 which is adjacent the outlet opening 24' is sodium zeolite, preferably zeolite Na—Y or zeolite Na—X. As shown in FIG. 4, the carbon layer 38' functions essentially as a universal adsorbent which physically and chemically adsorbs most toxic compounds. In addition, the compounds which are not completely adsorbed by the carbon layer 38 have their concentration substantially reduced. Water is also adsorbed by the carbon layer 38' so that it is prevented from entering the layer 60 and affecting the capacity of the layer to adsorb the carbon monoxide which passes through the carbon layer 38 and into the layer 60. Most of the toxic gases which manage to pass through the carbon layer 38 and the layer 60 pass into the sodium zeolite layer 62 where they are essentially physically and chemically adsorbed. Some basic gases may pass through the zeolite layer 62 but for the most part, the modified respiratory protection device 58 will protect the individual against toxic compounds for most of the emergency situations which are likely to be encountered. Also, the zeolite layer 62 provides a heat capacity mass to remove the heat of oxidation of the CO in the layer 60. Attached to the outside of the tube 16' is a visually discernible moisture indicator such as a DRIERITE pellet 47'.

Second Modification

Figure 5:
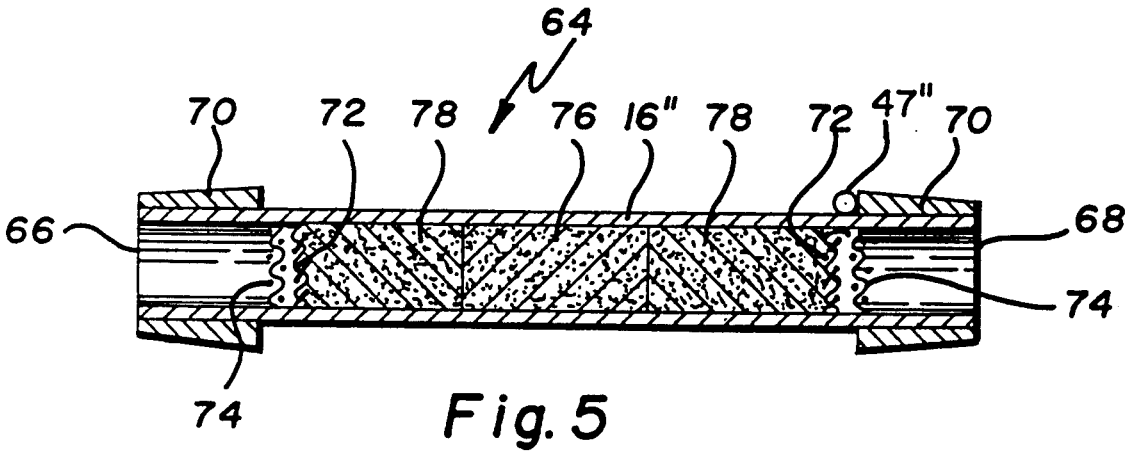
FIG. 5 is a view similar to FIG. 2 showing a second modified respiratory protection device.
Figure 6:
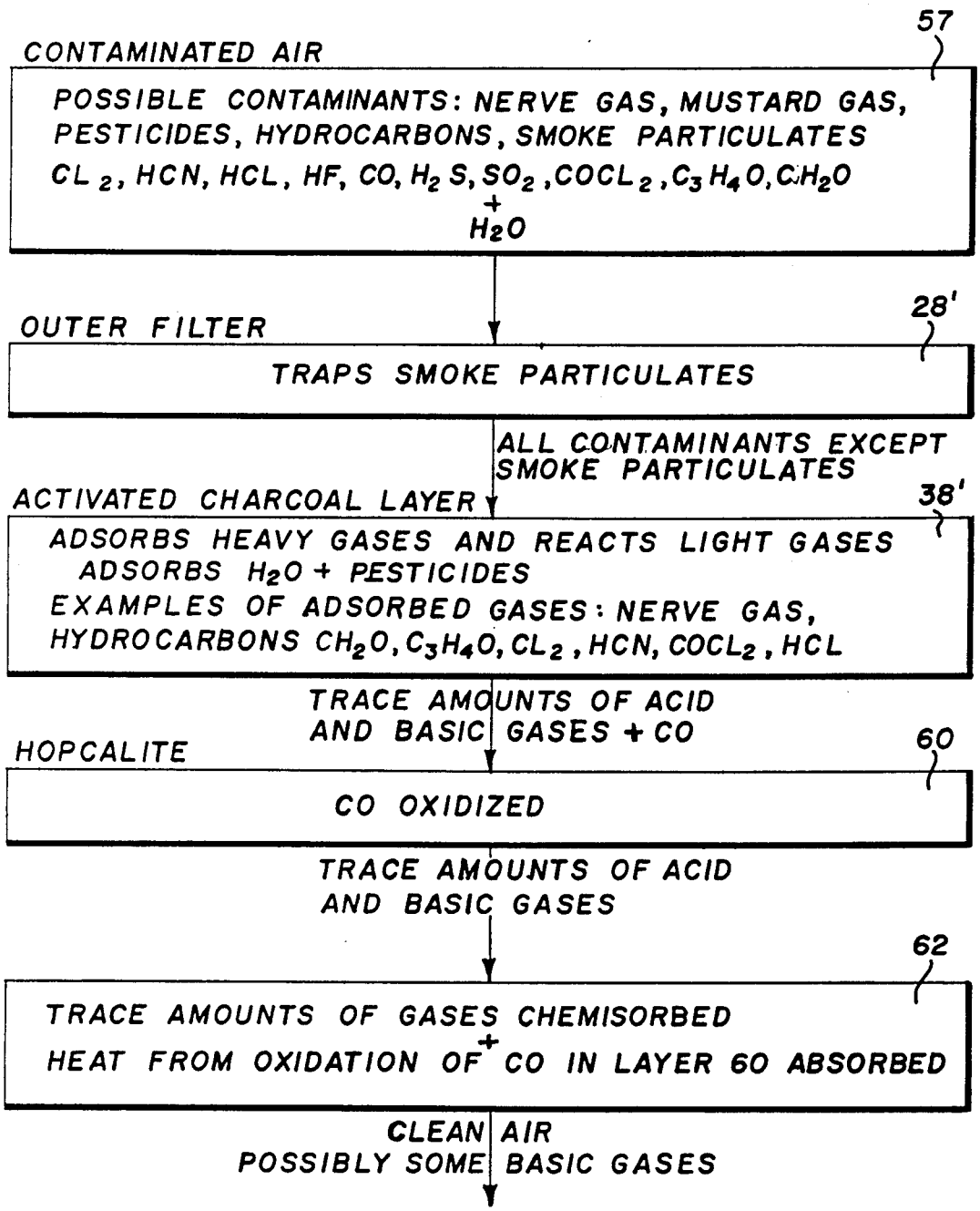
FIG. 6 is a block diagram similar to FIG. 3 and showing the filtration sequence for the first modification of FIG. 4.

Referring to FIG. 5, there is shown a second modified respiratory protection device, generally indicated by the reference numerals 64. The device 64 includes a rigid cylindrical tube 16'' which is similar to tube 16 except that it is symmetrical. The tube 16'' has an opening 66 at one end and an opening 68 at the opposite end. Openings 66 and 68 are each adapted to function as inlet and outlet openings. Each end of the tube 16'' is provided with a mouth piece 70 which is identical to mouth piece 26. A filter 72 is located across each of the openings 66 and 68 and is held in place by a screen 74. The tube 16'' contains adsorbent materials which is retained between the filters 72. Attached to the outside of tube 16'' is a visually discernible moisture indicator such as a DRIERITE pellet 47''.

The second modified respiratory protection device 64 is primarily intended for fire emergencies, wherein most of the compounds which are normally associated with fires are adsorbed by the impregnated active carbon layers 78 and the carbon monoxide is adsorbed by the oxidation catalyst layer 76. During use, one end of the the device 64 is inserted into the mouth and used in the same manner as the respiratory protection device 10. The first carbon layer 78 adsorbs most of the compounds from the fire. The second carbon layer 78 provides additional adsorbtive capacity as well as provides a heat sink for the heat which is generated by the exothermic oxidation of CO in the oxidation catalyst layer 76. However, the heat capacity of activated carbon is lower than zeolites. After a period of time, the device can be reversed so that the opposite end of the tube 16'' is inserted into the mouth of the user. This provides relatively fresh activated carbon at the entrance end of the tube for additional adsorptive capacity.

The plastic bag serves two main functions. First, the bag protects the device against moisture to preserve the effectiveness of the device. Secondly, the plastic bag protects the individual against lachrymators during use of the respiratory protection device.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A respiratory protection kit for protection against airborne toxic material and comprising:

(a) an elongated rigid tube having an inlet end and an inlet opening at said inlet end, an outlet end, and outlet opening at said outlet end, said outlet end being adapted to be held in the mouth of a user, (b) a filter for particulate material which is located across said inlet opening, (c) a first layer of impregnated active carbon adjacent said inlet opening for water absorption, said first layer being impregnated with metal oxides which react with HCN, (d) a second layer of an oxidation catalyst material between said first layer of impregnated active carbon and said outlet opening for oxidation of CO to $CO_2$, (e) a transparent bag having an open end which is adapted to fit over a user's head so that the user's nose and eyes are enclosed within the bag, and (f) means for sealing the open end of the bag about the user's head, wherein the elongated rigid tube is adapted to be stored within said transparent bag prior to being used and said bag is sealed to prevent moisture from entering the bag to maintain the effectiveness of said first and second layers, and wherein a visually discernable moisture indicator is located on the outside of said tube for indicating whether or not moisture has entered the bag.

2. Respiratory protection device as recited in claim 1, wherein said moisture indicator is $CaSO_4$.

3. A disposable respiratory protection device for short term protection against airborne toxic material and comprising:

(a) an elongated rigid tube having a first end, a first opening at said first end, a second end, and a second opening at said second end, each of said first and second ends having a mouthpiece which is adapted to be held in the mouth of a user, so that said respiratory protection device can be used in two orientations wherein in a first orientation said first end opening functions as an inlet opening and said second end opening functions as an outlet opening and wherein a second orientation, said first end opening functions as an outlet opening and said second end opening functions as an inlet opening, (b) a filter for particulate material which is located across each of said first end openings and said second end openings, (c) a first layer of impregnated active carbon adjacent said first opening for absorbing water, said first layer being impregnated with metal oxide salts which react with HCN, (d) a second layer of impregnated active carbon which is located adjacent said second opening for absorbing water, said second layer being impregnated with metal oxide salts which react with HCN, so that when said respiratory protection device is used in reverse, said first layer is upstream of said second layer with respect to airflow through said device, (e) a third layer of an oxidation catalyst material which is located between said first layer and said second layer for oxidation of CO to $CO_2$, and means for retaining said first, second and third layers within said tube.

* * * * *